US006186377B1

(12) United States Patent
McCormick et al.

(10) Patent No.: US 6,186,377 B1
(45) Date of Patent: Feb. 13, 2001

(54) SHIRT PRESSING MACHINE FOR LONG OR SHORT SLEEVE SHIRTS

(75) Inventors: John T. McCormick, Dushore; Michael J. King, Ulster; Robert A. Hadsall, Harvey's Lake, all of PA (US)

(73) Assignee: Hoffman/New Yorker, Inc., Bloomfield, NJ (US)

( * ) Notice: Under 35 U.S.C. 154(b), the term of this patent shall be extended for 0 days.

(21) Appl. No.: 09/557,216

(22) Filed: Apr. 25, 2000

(51) Int. Cl.[7] ..... A41M 5/00
(52) U.S. Cl. ..... 223/68; 223/74; 223/72
(58) Field of Search ..... 223/68, 72, 74, 223/52, 66

(56) References Cited

U.S. PATENT DOCUMENTS

| | | | |
|---|---|---|---|
| 3,198,407 | 8/1965 | Hughes . | |
| 3,568,900 | 3/1971 | Paris . | |
| 3,583,610 | 6/1971 | Forse . | |
| 3,613,969 * | 10/1971 | Forse | 223/57 |
| 3,624,795 | 11/1971 | Martin . | |
| 3,737,080 | 6/1973 | Paris . | |
| 3,961,733 * | 6/1976 | Kannegiesser et al. | 223/57 |
| 4,163,331 | 8/1979 | Renaut . | |
| 4,346,826 | 8/1982 | Ehemann . | |
| 4,689,905 | 9/1987 | Vartan . | |
| 5,474,216 * | 12/1995 | Harod et al. | 223/57 |
| 5,692,326 | 12/1997 | Mohan et al. . | |

OTHER PUBLICATIONS

Hoffman/New Yorker Brochure–CSS Series.

* cited by examiner

*Primary Examiner*—Bibhu Mohanty

(57) ABSTRACT

Shirt pressing apparatus capable of pressing long or short sleeve shirts. The apparatus includes a buck for receiving a shirt to be pressed and a sleeve expander assembly mounted on each side of the buck, the sleeve expander assembly being adjustable for use with either long or short sleeve shirts.

14 Claims, 2 Drawing Sheets

SHIRT PRESSING MACHINE FOR LONG OR SHORT SLEEVE SHIRTS

BACKGROUND OF THE INVENTION

This invention relates generally to a shirt pressing apparatus and more particularly to a machine having adjustable sleeve expanders which enable the machine to be used for pressing either long or short sleeve shirts.

Shirt pressing machines available in the marketplace have been limited to finishing long sleeve shirts. Generally those commercial machines include a buck for receiving a shirt to be pressed, the buck being movable between an exposed loading station at which an operator places a shirt on the buck, and a pressing chamber within which the shirt is exposed to steam and pressurized air during the pressing operation. Mounted at the side of the buck are clamps or grippers for gripping the cuffs of the long sleeve shirt and extension arms for extending the grippers away from the shirt during the shirt loading operation at the operator's station. When the buck is moved into the pressing chamber the grippers hold the sleeve in slight tension away from the shirt's body during the pressing operation. At the completion of the pressing operation, the buck is returned to the operator's station, the tensioning arms are relaxed and the shirt is removed from the buck. Typical prior commercial machines are the Model SBC-BV machines which have been marketed by the Assignee of this application, and also pressing machines such as those illustrated in U.S. Pat. No. 5,692,326.

Those prior art machines, however, have been limited to pressing long sleeve shirts and have not been adaptable to use with short sleeve shirts.

U.S. Pat. No. 3,568,900 illustrates a machine for pressing either long or short sleeve shirts, but the adjustable sleeve expander assemblies by which this is accomplished are rather complex in construction and thus are not cost effective.

Thus, a need exists in the marketplace for a machine which includes adjustable sleeve expanders which are economical and easy to manufacture and maintain, and which are readily adjustable for use with either long or short sleeve shirts. The novel invention disclosed and claimed in this application was developed to satisfy that need.

SUMMARY OF THE INVENTION

Accordingly, the primary objective of this invention is to provide an improved shirt pressing machine having novel adjustable sleeve expanders of simple and cost effective construction which quickly and readily adapt the machine for use with long or short sleeve shirts.

The above objective is accomplished by providing the buck of a conventional shirt pressing machine such as those mentioned above with sleeve expander assemblies which include upper and lower arms connected together at adjacent ends in such a way that the upper arm may be rotated about its longitudinal axis between a first position in which the axes of the arms are in alignment with each other and a second position in which they are angularly positioned with respect to each other. Connected to the upper arm of each assembly is a three prong cuff fork which is positioned to grasp a long sleeve shirt when the upper and lower arms are aligned with each other but is positioned to grasp a short sleeve shirt when the arms are angularly related to each other. The connection between the upper and lower arms is such that the adjustment between the upper and lower arms of the arm assembly is accomplished by cutting the mating ends of the arms on the same angle, e.g. a 15° angle, and then connecting the two ends together so that, when the equal angles of the mating ends are on opposite sides, the two arms form a straight arm assembly, but when the upper arm is rotated about its longitudinal axis 180° the equal angles of the connecting ends are on the same side so that the upper arm extends angularly inwardly with respect to the lower arm, thereby moving the cuff fork assembly closer to the buck for use with short sleeve shirts. The rotational adjustment or indexing through 180° of the upper arm with respect to the lower arm is quickly and easily made by an operator so that the operator may conveniently convert the machine for use with a run of long or short sleeve shirts.

The novel and unique adjustable sleeve expanders are of simple mechanical construction which are relatively easy and economical to manufacture, which require a minimal amount of maintenance during use, and which can be quickly and conveniently adjusted by an operator for use with long or short sleeve shirts as desired.

These and other objects of the invention will become apparent from reading the following detailed description of the invention in which reference is made to the accompanying drawings.

DETAILED DESCRIPTION OF THE INVENTION

Figures 1, 4, 5, 6, 7, 8, 9:
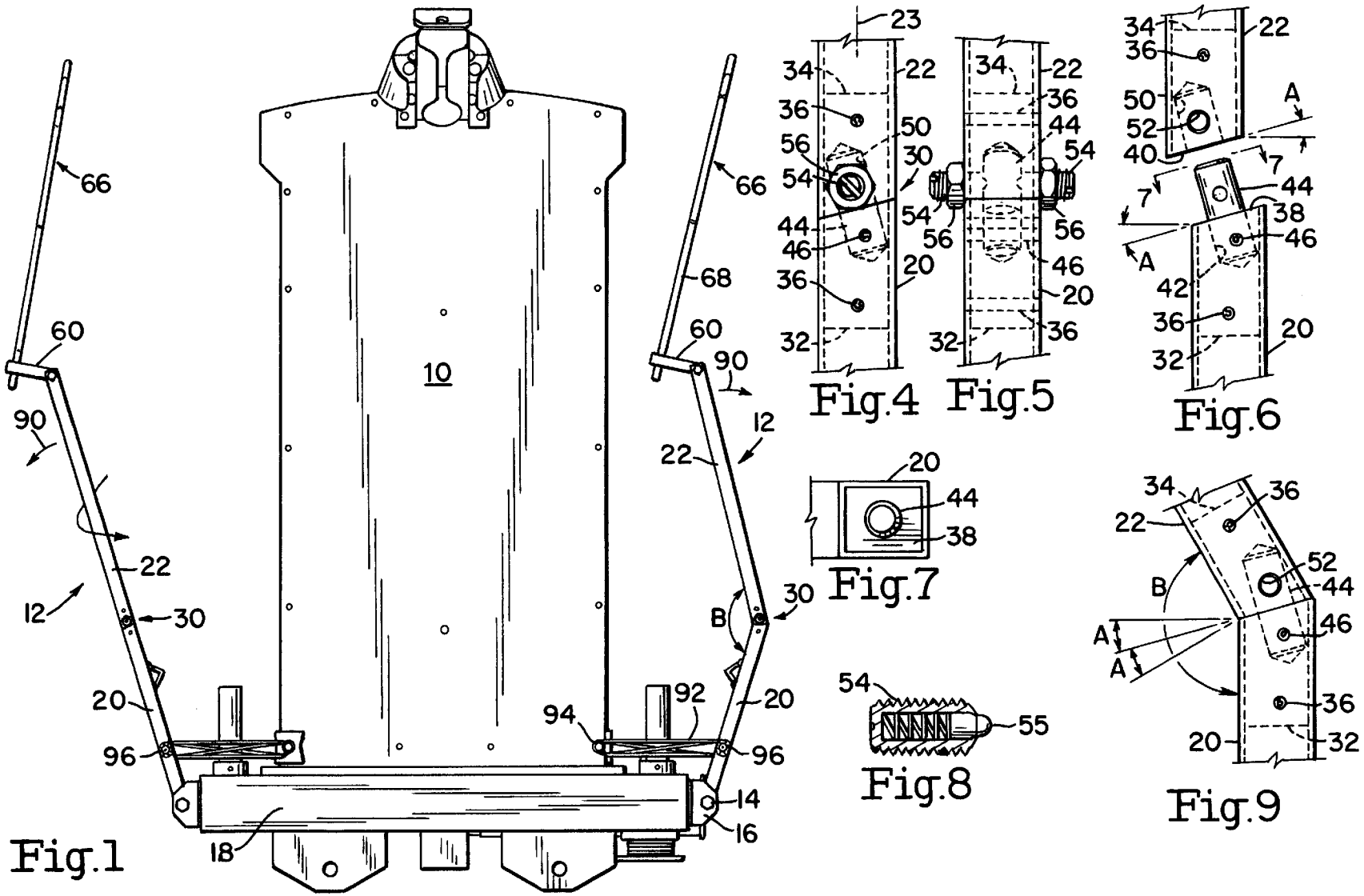
FIG. 1 is a schematic front elevation view of the buck of a shirt pressing machine and including the novel sleeve expander assemblies of the invention, with the right hand expander assembly adjusted for use with a short sleeved shirt and the left hand expander assembly adjusted for use with a long sleeved shirt.
FIG. 4 is an enlarged view of the coupling mechanism joining the upper and lower arms of the shirt expander assembly as it appears in FIG. 2 and taken along line 4—4 of FIG. 3.
FIG. 5 is an enlarged view of the coupling assembly as it appears in FIG. 3 and taken along line 5—5 of FIG. 4.
FIG. 6 is an exploded fragmentary view of the coupling assembly.
FIG. 7 is a view taken along line 7—7 of FIG. 6 illustrating the pin fixed in the lower arm and about which the upper arm rotates.
FIG. 8 illustrates one of the locking spring loaded detent assemblies by which the upper and lower arms are locked in one of the adjustable short or long sleeve shirt positions.
FIG. 9 is a fragmentary view of the coupling assembly, similar to FIG. 4, but with the upper arm rotated 180° adapted for use with a short sleeve shirt as exemplified by the right hand expander assembly of FIG. 1.

Referring now to FIG. 1, a shirt pressing apparatus constructed according to the invention includes a buck 10 which will be mounted on a frame for movement between an accessible shirt loading and unloading operator station at which a long or short sleeve shirt is placed around the buck and a pressing station within a cabinet in which flat pressing heads will press the front body and rear body of the shirt against the front and rear surfaces of the buck. During the pressing operation hot air and steam are passed through openings in the body and sleeve portions of the buck to finish the shirt and sleeves. The construction of buck 10, the manner in which it is incorporated in prior shirt pressing machines such as those mentioned above, and the way in which those machines operate are well known and will not be described in detail herein.

As already discussed, the pressing machine of the invention is provided with novel sleeve expander arm assemblies 12 which are pivotally connected at their lower ends via pivot bearing assembly 14 to mounting brackets 16 which are fastened to a horizontal base plate 18 of buck 10. Arm assemblies 12 are adjustable from a first position with respect to buck 10 (left side of the buck in FIG. 1) for pressing long sleeve shirts, and a second position with respect to buck 10 (right side of FIG. 1) for pressing short sleeve shirts.

Each shirt sleeve expander assembly 12 includes a lower arm 20 and an upper arm 22, each constructed from three-quarter inch square metal tubing. The lower end of arm 20 is welded to a hollow sleeve 24 which receives the pivoting bearing assembly 14.

Upper arm 22 is connected to lower arm 20 by a coupling assembly 30 which enables arm 22 to be rotated about its longitudinal axis 23 with respect to arm 20 to adjust arms 20 and 22 from a straight in line long sleeve position as shown on the left side of buck 10 in FIG. 1 to an angled inwardly directed short sleeve position as shown on the right side of buck 10 in FIG. 1.

A cuff clamp assembly 66 extends upwardly from arm 22 to receive the cuffs of either a long or short sleeve shirt.

As shown in FIGS. 4, 5, and 6, the joined ends of arms 20 and 22 are plugged with end plugs 32 and 34 which are retained therein by expansion pins 36. The end face 38 of arm 20 and plug 32 is machined at an angle A of about 15° and similarly the end face 40 of arm 22 and plug 34 is machined at the same angle A of about 15°. A hole 42 is drilled into plug 32 perpendicular to face 38 and a circular pin 44 is fixed into hole 42 by way of a lock pin 46. Similarly, a hole 50 is drilled into plug 34 perpendicular to end face 40 and a pair of drilled and tapped holes 52 extend through opposite sidewalls of arm 22 in communication with opening 50.

Figure 2:
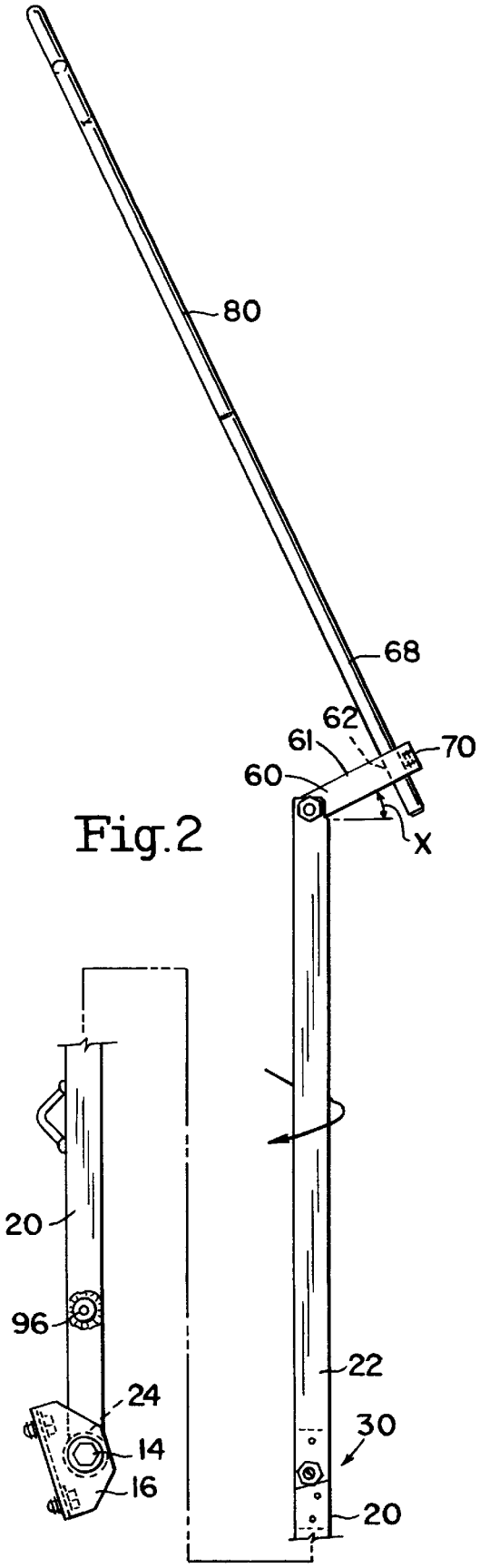
FIG. 2 is an enlarged schematic view of a right hand sleeve expander assembly adjusted for use with a long sleeved shirt.

As shown in FIGS. 4, 5, and 6, when pin 44 of arm 20 is inserted into opening 50 of arm 22 with the equal angles A on opposite sides of the arms, the arms 20 and 22 are in line with each other to form a straight arm assembly for use with long sleeve shirts. A right, side long sleeve assembly is illustrated in FIGS. 2, 4, and 6 while a left side, long sleeve assembly obtained by turning the assembly of FIG. 2 180° is illustrated on the left side of the buck 10 in FIG. 1. The assembled position of the arms 20 and 22 is retained by a pair of spring loaded detent assemblies 54 (FIG. 8) which thread into openings 52 and include a spring loaded plunger detent 55 which seats in an indent in pin 44, with lock nuts 56 holding assemblies 54 in place.

To adjust the position of arm 22 with the respect to arm 20 for use of the assembly with short sleeve shirts, arm 22 is rotated 180° about its axis 23 so that the equal angles A are on the same side of arms 20 and 22 to form an angle B of about 150° as shown in FIG. 9, with the arm 22 directed inwardly from arm 20 toward buck 10. This adjusted short sleeve position of arm assembly 12 is illustrated on the right hand side of buck 10 in FIG. 1. When the arms 20 and 22 are adjusted as in FIG. 9, spring loaded detents 54 act to retain that adjustment in place.

A short square bar 60 is fastened at 62 to the upper end of arm 22 and extends laterally therefrom at an angle X of about 26.5° to the horizontal. A hole 62 is drilled through bar 60 perpendicular to its upper face 61 and adjacent its outer end. The cuff fork assembly 66 extends upwardly from bar 60 and includes an elongated central circular rod 68, the lower end of which fits through opening 62 and is retained therein by set screw 70 extending inwardly from the outer end of bar 60 and frictionally engaging against rod 68. A long cuff fork 72 is formed on one side of rod 68 by an elongated circular rod which has its lower end welded at 74 to rod 68 and forms an elongated slot or opening 76 between rods 68 and 72 extending from the weld area 74 towards the top of rod 72. A short cuff fork 80 is formed on the other side of rod 68 by a short circular rod which is welded at 82 to rod 68 at about its mid-point and an elongated slot or opening 84 is formed between rods 80 and 68 and extends from the weld area 82 towards the upper end of rod 68. The upper ends of cuff forks 72 and 80 are bent outwardly away from center rod 68 to facilitate the placement of the cuffs of the shirt down into slots 76 and 84. The cuffs of a shirt fit snuggly into slots 76 and 84 so that they are grasped firmly between center rod 68 and cuff fork 72 or fork 80.

The fork assembly 66 is properly positioned in bar 60 so that, when the arms 20 and 22 are in straight-line relationship, the short cuff fork 80 should be facing the operator as he stands in front of buck 10. This is apparent in the right hand arrangement illustrated in FIG. 2 wherein the short cuff fork 80 is viewed by an operator looking into the figure. For the left hand arrangement illustrated on the left hand side of FIG. 1, rod 68 should be rotated through 180° so that the short fork 80 on the left hand side also faces the operator.

As is apparent from the left side assembly 12 in FIG. 1, when the assemblies 12 are adjusted for use with a long sleeve shirt, the cuff clamp assembly 66 extends upwardly and inwardly toward buck 10, thus placing slot 76 in position to receive the long sleeve. When the assemblies 12 are adjusted for use with a short sleeve shirt as illustrated by the right side assembly in FIG. 1, clamp assembly 66 extends upwardly and outwardly from the buck, placing slot 84 in position to receive the short sleeve.

As mentioned above, the sleeve expander assemblies 12 are laterally movable from the inner retracted position illustrated in FIG. 1 in which the sleeves of a shirt are relaxed and the cuffs of that shirt are placed within the cuff fork 66 and an outer lateral position in the direction of arrows 90 in which the sleeves of the shirts are held in a tensioned condition during the pressing operation. A combined air cylinder spring arrangement 92 connected at one end 94 to buck 10 and at its other end to lugs 96 moves the expander assemblies laterally back and forth with respect to buck 10.

Figure 3:
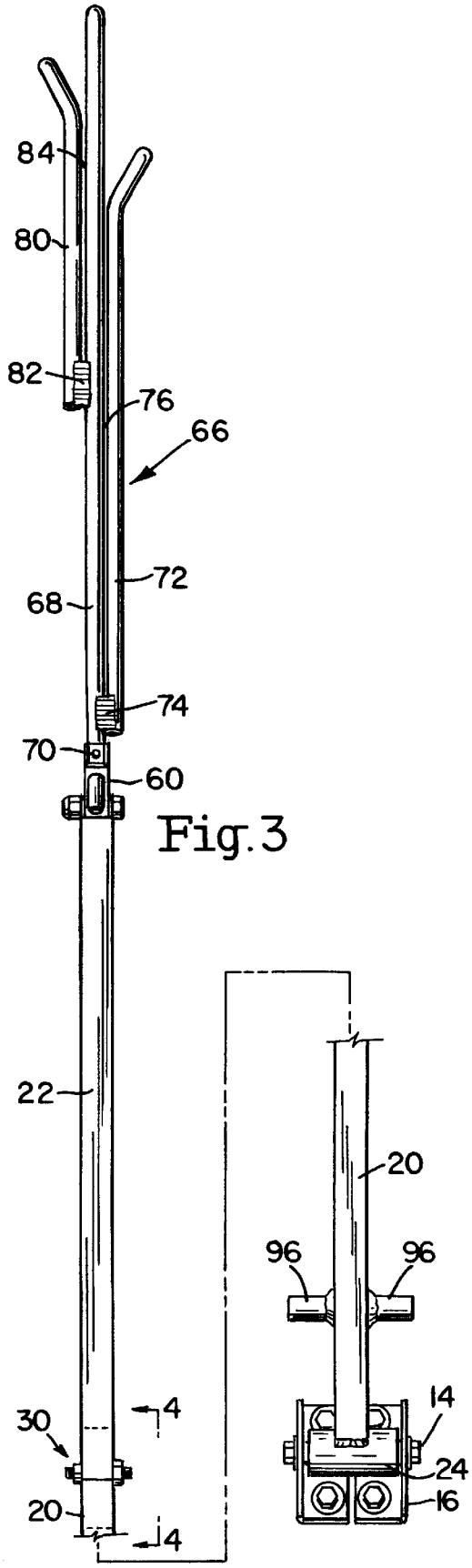
FIG. 3 is a side view taken along line 3—3 of FIG. 2 and illustrating in particular the configuration of the cuff engaging fork assembly.

When long sleeved shirts are to be pressed, arms 20 and 22 of expander assemblies 12 are held in straight alignment as illustrated by the left hand expander assembly of FIG. 1 and the right hand expander assembly illustrated in FIG. 2 and 3. The position of coupling assembly 30 and the mating ends of 20 and 22 is illustrated in FIGS. 4, 5, and 6. As shown in FIG. 1, with the assembly 12 adjusted for use with long sleeve shirts, when the assembly is in its relaxed position the cuff fork assembly 66 is spaced a longer distance from the shoulder portion of buck 10 so that the cuffs of a long sleeve may be conveniently inserted downwardly into the long sleeve slot 76. When the air assembly 92 is then actuated, the expander assembly 12 is moved laterally away from buck 10 a sufficient distance to place the long sleeve in a tensioned condition. As in conventional machines the buck 10 is then moved from the operator loading station into a pressing chamber and, when pressing is completed, buck 10 is returned to the operator station. The air cylinder assembly 92 is then deactivated and expanders 12 are returned to the relaxed position of FIG. 1 and the cuffs of the shirt are then removed upwardly through slot 76 from fork assembly 66.

When short sleeve shirts are to be pressed an operator may quickly adjust the expander assemblies 12 from the long sleeve position illustrated on the left-hand side of FIG. 1 to the short sleeve position illustrated on the right hand side. This is accomplished merely by rotating upper arm 22 about its longitudinal axis 23 through 180° with respect to lower arm 20 to the angular position illustrated in FIG. 9, and the spring loaded detent assemblies 54 retain arms 20 and 22 in that angular position. As shown on the right hand side of FIG. 1, this brings the cuff assembly 66 much closer to the shoulder area of buck 10 in a position such that the short sleeve of the shirt may be conveniently placed into the elongated slot 84 of the cuff yolk assembly 66. When the short sleeve shirt is thus loaded on buck 10, the air cylinder assembly 92 is actuated moving the expander assemblies 12 laterally away from buck 10 and placing the short sleeves of the shirt in tension. The buck 10 is then moved from the operator loading station into the pressing chamber, the shirt is pressed, the buck is subsequently returned to the operator station for unloading, the air cylinders are deactivated and the short sleeves of the pressed shirt are removed upwardly out of slots 84.

Thus, is it readily apparent that the adjustable sleeve expander assemblies 12 of the invention advantageously and conveniently provide a pressing machine capable of pressing either long or short sleeve shirts. The assemblies 12 are of relatively simple mechanical construction and may be quickly and easily adjusted by an operator to accommodate either long or short sleeve shirts. Because of the relatively simple construction of the arm assemblies, maintenance costs and time are minimal.

The foregoing relates to preferred exemplary embodiments of the invention, it being understood that other variants and embodiments thereof are possible within the spirit and scope of the invention, the latter being defined by the appended claims.

What is claimed is:

1. Shirt pressing apparatus comprising a buck for receiving a shirt to be pressed, a sleeve expander assembly mounted on each side of said buck for movement from a sleeve loading location away from said buck to maintain said sleeve tensioned during a pressing operation, said sleeve expander assembly including lower arm means mounted at its lower end for movement away from and back towards said buck, upper arm means, coupling means connecting the upper end of said lower arm means to the lower end of said upper arm means, cuff clamp means connected to the upper end of said upper arm means, said coupling means being constructed so as to enable said upper arm means to be rotated approximately 180° about its longitudinal axis with respect to said lower arm means and thereby to be adjusted from a first position in which said upper arm means is in axial alignment with said lower arm means for use with a long sleeve shirt to a second position in which said upper arm means is angled inwardly with respect to said lower arm means toward said buck for use with a short sleeve shirt.

2. The shirt pressing apparatus of claim 1, wherein the upper end of said lower arm means and the lower end of said upper arm means have mating angled faces, said coupling means including a pin extending perpendicularly from one of said faces and a bore extending perpendicularly within the other mating face for receiving said pin, whereby when said upper arm means is rotated through 180° said pin and said bore cause said upper arm means to move from said first aligned position to said second angled position.

3. The shirt pressing apparatus of claim 2, said coupling means including locking means for holding said first and second arm means in said first aligned position or in said second angled position.

4. The shirt pressing apparatus of claim 2, said cuff clamp means being a three-prong fork including a first elongated center rod connected to the upper end of said upper arm means, a second elongated rod fastened on one side of said first rod adjacent the bottom thereof and defining a first upwardly opening elongated slot therewith for receiving the sleeve of a long sleeve shirt, and a third rod fastened on an opposite side of said first rod approximately at a mid-point thereof and defining a second upwardly opening slot therewith for receiving the sleeve of a short sleeve shirt.

5. The shirt pressing apparatus of claim 4, wherein said third rod extends higher along said first rod than does said second rod.

6. The shirt pressing apparatus of claim 4, whereby when said upper and lower arm means are in straight alignment, said center rod is connected to said upper arm means in such a way that said third rod is facing the operator of the machine.

7. The shirt pressing apparatus of claim 6, comprising means connecting said cuff clamp means to the upper end of said upper arm means in such a way that when said upper and lower arm means are in alignment with each other said three-prong fork is angled inwardly toward said buck and said first elongated slot is positioned to receive the sleeve of a long sleeve shirt and when said upper and lower arm means are angled with respect to each other said fork is angled outwardly away from said buck with said second slot positioned to receive the sleeve of a short sleeve shirt.

8. For use with shirt pressing apparatus comprising a buck for receiving a shirt to be pressed, a sleeve expander assembly adapted to be mounted on a side of the buck for movement from a sleeve loading location away from the buck to maintain said sleeve tensioned during a pressing operation, said sleeve expander assembly including lower arm means adapted to be mounted at its lower end for movement away from and back towards said buck, upper arm means, coupling means connecting the upper end of said lower arm means to the lower end of said upper arm means, cuff clamp means connected to the upper end of said upper arm means, said coupling means being constructed so as to enable said upper arm means to be rotated approximately 180° about its longitudinal axis with respect to said lower arm means and thereby to be adjusted from a first position in which said upper arm means is in axial alignment with said lower arm means for use with a long sleeve shirt to a second position in which said upper arm means is angled inwardly with respect to said lower arm means toward the buck for use with a short sleeve shirt.

9. The sleeve expander assembly of claim 8, wherein the upper end of said lower arm means and the lower end of said upper arm means have mating angled faces, said coupling means including a pin extending perpendicularly from one of said faces and a bore extending perpendicularly within the other mating face for receiving said pin, whereby when said upper arm means is rotated through 180° said pin and said bore cause said upper arm means to move from said first aligned position to said second angled position.

10. The sleeve expander assembly of claim 9, said coupling means including locking means for holding said first and second arm means in said first aligned position or in said second angled position.

11. The sleeve expander assembly of claim 9, said cuff clamp means being a three-prong fork including a first elongated center rod connected to the upper end of said upper arm means, a second elongated rod fastened on one side of said first rod adjacent the bottom thereof and defining a first upwardly opening elongated slot therewith for receiving the sleeve of a long sleeve shirt, and a third rod fastened on an opposite side of said first rod approximately at a mid-point thereof and defining a second upwardly opening slot therewith for receiving the sleeve of a short sleeve shirt.

12. The sleeve expander assembly of claim 11, wherein said third rod extends higher along said first rod than does said second rod.

13. The sleeve expander assembly of claim 11, whereby when said upper and lower arm means are in straight alignment, said center rod is connected to said upper arm means in such a way that said third rod is facing the operator of the machine.

14. The sleeve expander assembly of claim 13, comprising means connecting said cuff clamp means to the upper end of said upper arm means in such a way that when said upper and lower arm means are in alignment with each other said three-prong fork is angled inwardly toward said buck and said first elongated slot is positioned to receive the sleeve of a long sleeve shirt and when said upper and lower arm means are angled with respect to each other said fork is angled outwardly away from said buck with said second slot positioned to receive the sleeve of a short sleeve shirt.

* * * * *